US010544578B2

(12) United States Patent
DeBuff

(10) Patent No.: US 10,544,578 B2
(45) Date of Patent: Jan. 28, 2020

(54) FLASHING FOR CONCRETE BOARD SIDING

(71) Applicant: Todd DeBuff, Nashville, TN (US)

(72) Inventor: Todd DeBuff, Nashville, TN (US)

( * ) Notice: Subject to any disclaimer, the term of this patent is extended or adjusted under 35 U.S.C. 154(b) by 0 days.

(21) Appl. No.: 15/867,562

(22) Filed: Jan. 10, 2018

(65) Prior Publication Data

US 2018/0127974 A1 May 10, 2018

Related U.S. Application Data

(63) Continuation of application No. 14/857,443, filed on Sep. 17, 2015, now Pat. No. 9,951,514.

(51) Int. Cl.

| | |
|---|---|
| ***E04B 1/64*** | (2006.01) |
| ***E04F 13/08*** | (2006.01) |
| ***E04F 13/14*** | (2006.01) |
| ***E04B 1/68*** | (2006.01) |
| ***E04B 2/00*** | (2006.01) |
| ***E04F 19/00*** | (2006.01) |

(52) U.S. Cl.

CPC ..... *E04B 1/64* (2013.01); *E04B 1/68* (2013.01); *E04B 2/00* (2013.01); *E04F 13/0833* (2013.01); *E04F 13/0887* (2013.01); *E04F 13/148* (2013.01); *E04F 19/00* (2013.01)

(58) Field of Classification Search

CPC ..... E04F 13/0864; E04F 19/062; E04D 2001/3414; E06B 1/62

USPC ..... 52/547, 549, 551, 552

See application file for complete search history.

(56) References Cited

U.S. PATENT DOCUMENTS 2,519,656 A * 8/1950 Howe ..... E04D 3/365 269/289 R 2,522,067 A * 9/1950 Sperry ..... E04D 3/366 52/409

(Continued)

FOREIGN PATENT DOCUMENTS

JP 2002-266491 A 9/2002

OTHER PUBLICATIONS

Bear Cub Products, Bear Skin Pad, Dec. 17, 2015, www.bearcubproducts.com, US.

(Continued)

*Primary Examiner* — Brent W Herring

(74) *Attorney, Agent, or Firm* — Bradley Arant Boult Cummings LLP; Timothy L. Capria

(57) ABSTRACT

A flashing for concrete board siding includes a substantially rigid panel, a guide protrusion, an interior protrusion and at least one strip of adhesive double-sided tape. The guide protrusion and interior protrusion are integrally formed with the panel at opposing ends. The at least one strip of adhesive double-sided tape is on an exterior face of the panel. In an embodiment, a channel separates two or more strips. Some embodiments include at least one groove disposed between two or more strips. Further, a method of installing concrete board siding to a structure includes fastening a first piece of cement board siding to the structure, providing an embodiment of the flashing disclosed herein, positioning the interior protrusion on the top edge, adhering a second piece of cement board siding to the least one strip of adhesive double-sided tape and fastening the second piece of cement board siding to the structure.

19 Claims, 4 Drawing Sheets

(56) References Cited

U.S. PATENT DOCUMENTS 2,648,103 A * 8/1953 Wahlfeld ..... E04F 13/0803 52/471
2,820,535 A 1/1958 Hutchison
3,086,324 A 4/1963 Cheney
5,065,553 A 11/1991 Magid
5,109,641 A 5/1992 Halan
5,564,245 A * 10/1996 Rademacher ..... E04F 13/0864 52/520
5,617,690 A * 4/1997 Gibbs ..... E04D 1/34 52/518
5,794,396 A * 8/1998 Gibbs ..... E04D 1/16 52/518
5,806,185 A 9/1998 King
6,052,961 A * 4/2000 Gibbs ..... E04D 1/16 52/518
6,421,975 B2 7/2002 Bryant et al.
6,434,853 B2 * 8/2002 Pyburn ..... E04F 21/1855 33/411
7,721,488 B1 5/2010 Bennett
7,784,222 B2 8/2010 Bennett
8,191,327 B2 * 6/2012 Griffiths ..... E04F 13/0825 24/457
8,316,586 B2 11/2012 Ellingson
8,407,960 B2 * 4/2013 Morsching ..... E04D 13/15 248/124.1
8,409,380 B2 4/2013 Black et al.
8,448,401 B2 5/2013 Schaefer
8,528,265 B1 9/2013 Preston
8,661,761 B2 * 3/2014 Williams ..... E04D 1/34 52/551
8,695,303 B2 4/2014 Swanson
8,763,343 B2 7/2014 Dodge, Sr. et al.
8,782,960 B2 7/2014 Nark et al.
8,844,235 B2 * 9/2014 Lukaszewicz ..... E04F 13/083 52/506.06
8,863,461 B2 10/2014 Wagner et al.
8,910,444 B2 12/2014 Wilson et al.
8,959,842 B2 2/2015 Norwood
2002/0178671 A1 * 12/2002 Gembala ..... E04D 3/405 52/302.6
2003/0056444 A1 * 3/2003 Ackerman, Jr. ..... E06B 1/62 52/58
2003/0061771 A1 * 4/2003 Kintop ..... E04D 13/155 52/97
2003/0177736 A1 9/2003 Gatherum
2008/0209834 A1 9/2008 Ouellette et al.
2009/0056235 A1 * 3/2009 Morsching ..... E04D 13/15 52/58
2009/0064599 A1 * 3/2009 Bennett ..... E04F 13/0864 52/60
2009/0090068 A1 * 4/2009 O'rourke ..... E06B 1/62 52/58
2009/0229193 A1 * 9/2009 Ellingson ..... E06B 1/62 52/58
2014/0208679 A1 7/2014 Schaefer
2014/0290152 A1 * 10/2014 Morsching ..... E04D 13/15 52/61
2016/0160497 A1 * 6/2016 Randlett ..... E04F 13/007 52/61

OTHER PUBLICATIONS

Tamlyn Online Store, ProLine Plank Flash, Dec. 17, 2015, www.tamlynstore.com, US.
Simplicity Tool Corp, Junction Flashing for Fiber Cement Siding, Dec. 17, 2015, www.simplicitytool.com/juncton_hanger.

* cited by examiner

FLASHING FOR CONCRETE BOARD SIDING

CROSS-REFERENCE TO RELATED APPLICATION

This application is a continuation of, and therefore claims priority to and the benefit of, pending U.S. patent application Ser. No. 14/857,443, filed Sep. 17, 2015.

TECHNICAL FIELD

The present disclosure relates to a flashing for concrete board siding. More specifically, the disclosure is directed to a flashing that includes a substantially rigid panel, a guide protrusion, an interior protrusion, and at least one strip of adhesive double-sided tape. The instant disclosure is also directed towards processes and products related to easy installation of cement board siding.

BACKGROUND

Siding is frequently used as a building material for the exterior of structures, including homes, garages and commercial buildings. Concrete board siding is a popular type of siding. Concrete board siding is constructed of a mixture of sand, cement and cellulose. Concrete board siding is economical, durable, resistant to rot, resistant to wood-eating insects, non-combustible and may be constructed in a variety of shapes, sizes and styles. Moreover, concrete board siding may be treated with exterior stain or paint.

Given its many desirable properties, it is unsurprising that concrete board siding has become a preferred siding material. However, concrete board siding does have some disadvantageous properties, especially relating to interaction between siding pieces and concrete board siding installation. Concrete board siding is relatively heavy, unwieldly to install, prone to breakage during installation and its pieces must be installed individually. In particular, concrete board siding generally must be installed from the bottom of the structure upwards, one piece of concrete board siding at a time. Installation of concrete board siding has included the need to measure, hold, position and fasten each piece of concrete board siding, and in many instances requires at least two installers.

Accordingly, a need exists for making concrete board siding easier and faster to install. The flashing(s) and method(s) of this disclosure significantly reduce the effort and time with which concrete board siding is installed.

BRIEF SUMMARY

In one embodiment, a flashing includes a rigid panel, a guide protrusion and an interior protrusion. The rigid panel includes a top portion, a bottom portion and an exterior face. The guide protrusion is integrally formed with the top portion, and the interior protrusion is integrally formed with the bottom portion. The rigid panel can include a panel height, and the guide protrusion can include a guide protrusion height of between about 2 millimeters (mm) and about 25 mm. The rigid panel may also have a panel width of from about 75 mm to about 2000 mm, preferably from about 100 mm to about 1500 mm. The interior protrusion can include an interior protrusion length of between about 2 mm and about 25 mm. The flashing includes at least one strip of adhesive double-sided tape adhered to the exterior face.

The flashing can, in some embodiments, include an offset portion integrally formed with the bottom portion. The interior protrusion may be integrally formed with the offset portion. The offset portion may have an offset portion length of from about 5 mm to about 50 mm.

In various embodiments, the at least one strip of adhesive double-sided tape may include two, three, or four or more strips of adhesive double-sided tape. The strips of double-sided tape may be separated by a channel. Each strip of adhesive-double sided tape may include a tape width of from about 5 mm to about 60 mm.

In an embodiment, a method of installing cement board siding to a structure is provided and includes fastening a first piece of cement board siding to the structure, the first piece of cement board siding including a top edge; providing a flashing having: a rigid panel including a top portion, a bottom portion, and an exterior face; a guide protrusion integrally formed with the top portion; an interior protrusion integrally formed with the bottom portion; and at least one strip of adhesive double-sided tape adhered to, or secured with, the exterior face; positioning the interior protrusion on the top edge; adhering a second piece of cement board siding to the least one strip of adhesive double-sided tape; and fastening the second piece of cement board siding to the structure.

The method of installing cement board siding can include guiding the second piece of cement board siding with the guide protrusion.

In yet another embodiment, the at least one strip of adhesive double-sided tape includes at least one protective layer. The at least one protective layer may be removed prior to adhering the second piece of cement board siding to the least one strip of adhesive double-sided tape.

DETAILED DESCRIPTION

Figure 1:
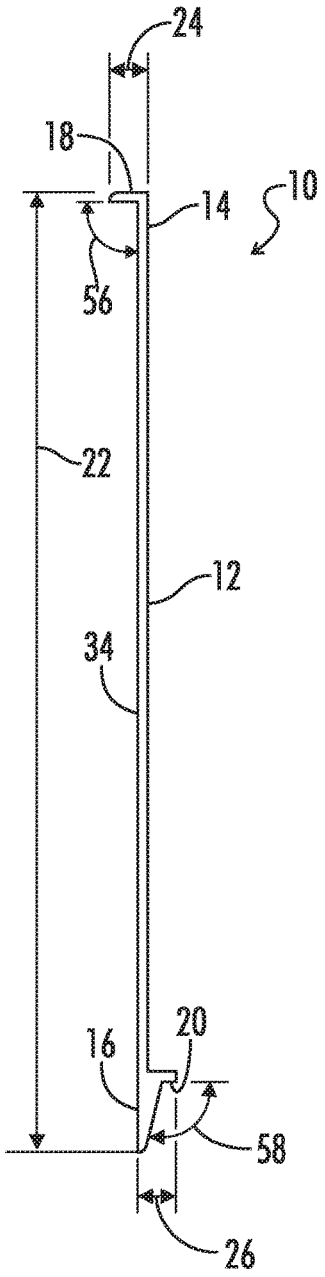
FIG. 1 is a side view of an embodiment of a flashing.

Reference now will be made in detail to the embodiments of the present disclosure. It will be apparent to those of ordinary skilled in the art that various modifications and variations can be made to the teachings of the present disclosure without departing from the scope of the disclosure. For instance, features illustrated or described as part of one embodiment, can be used with another embodiment to yield a further embodiment.

Thus, it is intended that the present disclosure covers such modifications and variations as come within the scope of the appended claims and their equivalents. Other objects, features and aspects of the present disclosure are disclosed in or are apparent from the following detailed description. It is to be understood by one of ordinary skill in the art that the present disclosure is a description of exemplary embodiments only and is not intended as limiting the broader aspects of the present disclosure.

For the sake of clarity, not all reference numerals are necessarily present in each drawing Figure. In addition, positional terms such as "upper," "lower," "side," "top," "bottom," "vertical," "horizontal," etc. refer to the flashing when in the orientation shown in the drawings. The skilled artisan will recognize that flashings can assume different orientations when in use.

A side view of a flashing 10 is shown in FIG. 1. Flashing 10 is intended for use with concrete board siding. Flashing 10 may be constructed of rigid, or substantially rigid, material. "Substantially rigid" means that flashing 10 has sufficient material strength to support the weight of concrete board siding and hold concrete board siding in-place prior to and/or after the concrete board siding is fastened to a structure. For example, flashing 10 may be constructed of steel, iodized aluminum or an organic polymer having a high molecular mass, such as high-density polyethylene. In an embodiment, flashing 10 is constructed of 10 to 40 gauge steel sheet metal, preferably 20 to 30 gauge steel sheet metal. Flashing 10 may be coated with paint to match the color of concrete board siding with which it is associated.

Flashing 10 includes a substantially rigid panel 12. Substantially rigid panel 12 has a top portion 14, a bottom portion 16, and an exterior face 34 (shown in FIGS. 4-6). Panel 12 may have a panel height 22 of from about 50 mm to about 500 mm, preferably from about 100 mm to about 400 mm. Panel height 22 may be about 6.35 mm less than the concrete board siding length of the concrete board siding which with flashing 10 is associated. Panel 12 may have a panel width 32 of from about 10% to about 50% of the panel height 22. Panel height 22 and panel width 32 may be varied relative to the dimensions of the concrete board siding associated with flashing 10. Flashing 10 may be configured to be used in conjunction with varying siding sizes, such as the popular siding width sizes of 5.25 inches, 6.25 inches, 7.25 inches, 8.25 inches, 9.25 inches and 12 inches. Flashing 10 may be configured to be used in conjunction with varying siding sizes by an installer, including in the field. For example, in one embodiment, panel 12 includes at least one line 64 along which panel is perforated, scored or bendable. Line 64 may be at predetermined positions such that flashing 10 is installable with multiple siding widths, including popular width sizes. In an embodiment having more than one line 64, lines 64 are positioned so that each line corresponds to a popular siding width size so that an installer may break or bend flashing 10 along line 64 creating a panel height 22 and a new top portion 14 or guide protrusion 18 that corresponds with the siding width of the siding being installed.

Top portion 14 includes a guide protrusion 18. In an embodiment, guide protrusion 18 is integrally formed with top portion 14. Guide protrusion 18 may have a guide protrusion length 24 of from about of between about 2 mm and about 25 mm, preferably between about 4 mm and about 20 mm. In an embodiment, the guide protrusion length 24 is from about 1% to about 10% of panel height 22. Guide protrusion 18 and top portion 14 may intersect to form a guide protrusion junction having an angle of from about 70 degrees to about 110 degrees.

Figure 3:
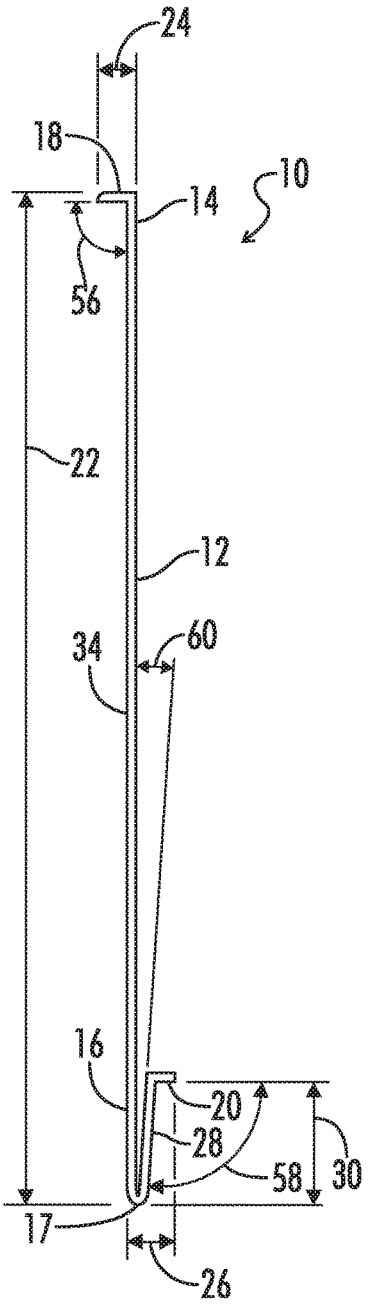
FIG. 3 is a side view of yet another embodiment of a flashing.

In an embodiment, guide protrusion 18 is configured to be removable from panel 12. For example, panel 12 may be perforated along line 64 (as shown in FIG. 3). Line 64 may be disposed between guide protrusion 18 and panel 12 such that guide protrusion 18 is configured to be snapped off via the perforation by an installer before or after concrete board siding is installed with flashing 10 and fastened to a structure. Guide protrusion 18 may be snapped off by, for example, applying pressure against the guide protrusion 18 so that the perforation breaks along line 64. In another embodiment, flashing 10 does not include guide protrusion 18.

Bottom portion 16 includes an interior protrusion 20. In an embodiment, interior protrusion 20 is integrally formed with bottom portion 16. Interior protrusion 20 may have an interior protrusion length 26 of between about 2 mm and about 25 mm. In another embodiment, interior protrusion length is from about 1% to about 10% of panel height 22. Interior protrusion 20 and bottom portion 16 may intersect to form an interior protrusion junction 58 having an angle of from about 70 degrees to about 110 degrees, preferably about 90 degrees.

Figure 2:
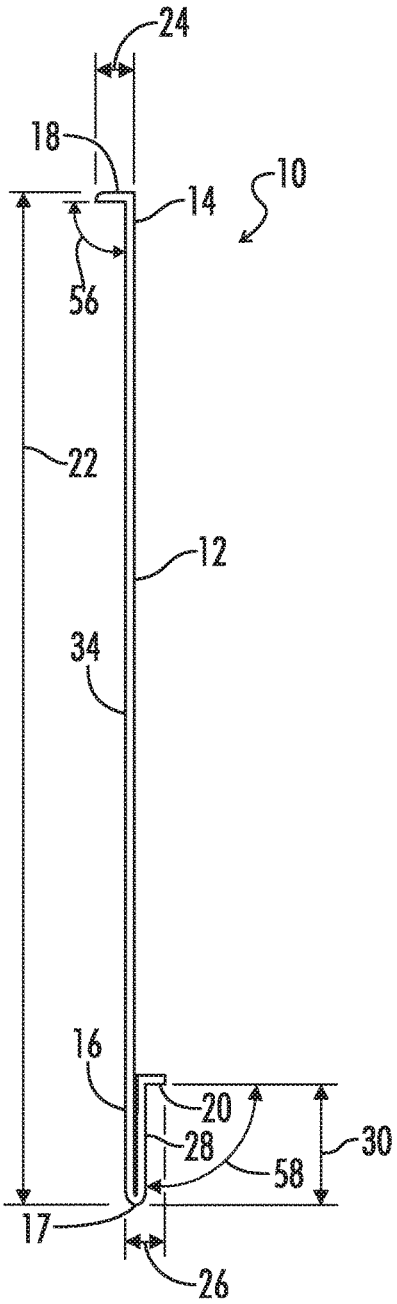
FIG. 2 is a side view of another embodiment of a flashing.

A side view of an alternate embodiment of flashing 10 is shown in FIG. 2. In the embodiment of FIG. 2, flashing 10 includes an offset portion 28 on bottom portion 16. Offset portion 28 may be integrally formed with bottom portion 16.

A side view of an another embodiment of flashing 10 is shown in FIG. 3. In the embodiment of FIG. 3, offset portion 28 and bottom portion 16 may form an offset portion junction 60 having an angle of from 0 degrees to about 40 degrees, preferably from 0 degrees to about 20 degrees, most preferably from 0 degrees to about 5 degrees. In an embodiment constructed from sheet metal, offset portion 28 may be formed by folding panel 12 to define a bottom edge 17 so an offset portion 28 extends upwards and so that interior protrusion 20 is a second fold.

Figure 4:
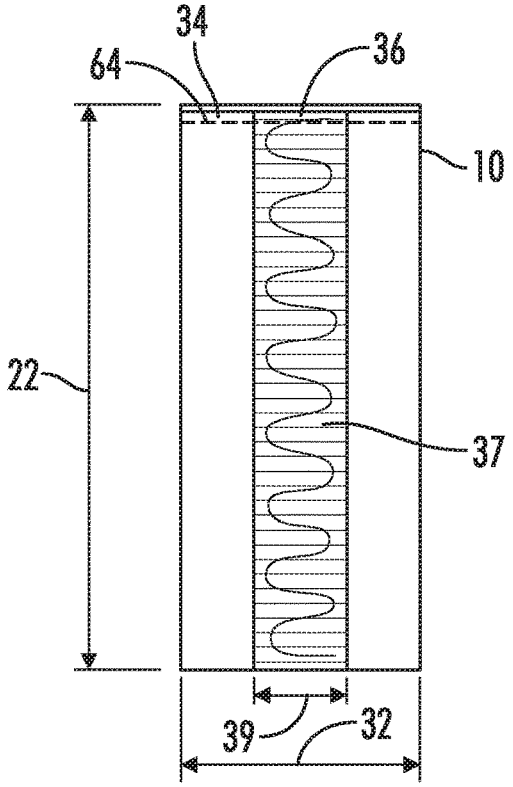
FIG. 4 is an elevation view of one embodiment of a flashing.

An elevation view of an embodiment of flashing 10 is shown in FIG. 4. Flashing 10 includes a panel width 32 that is from about 75 mm to about 2000 mm, preferably from about 100 mm to about 1500 mm. In an embodiment, panel width 32 may be from about 10% to about 50% of panel height 22. Panel 12 has an exterior face 34. At least one piece of adhesive tape is secured to exterior face 34. For example, in one embodiment, at least one strip of adhesive double-sided tape 36 has one side adhesively secured to exterior face 34. At least one strip of adhesive-sided tape 36 may have a tape width 39 of from about 5 mm to about 60 mm. In an embodiment, tape width 39 may be from about 20% to about 200% of the channel width 40. Tape width 39 may be from about 10% to about 100% of panel width 32. Adhesive tape 36 may be positioned along an exterior side 44 of panel 12 (as shown) or recessed from exterior side 44 of panel 12. Adhesive tape 36 may be of sufficient adhesiveness to retain a piece of concrete board siding in a position temporarily, i.e., until the installer fastens the piece of concrete board siding.

Figure 5:
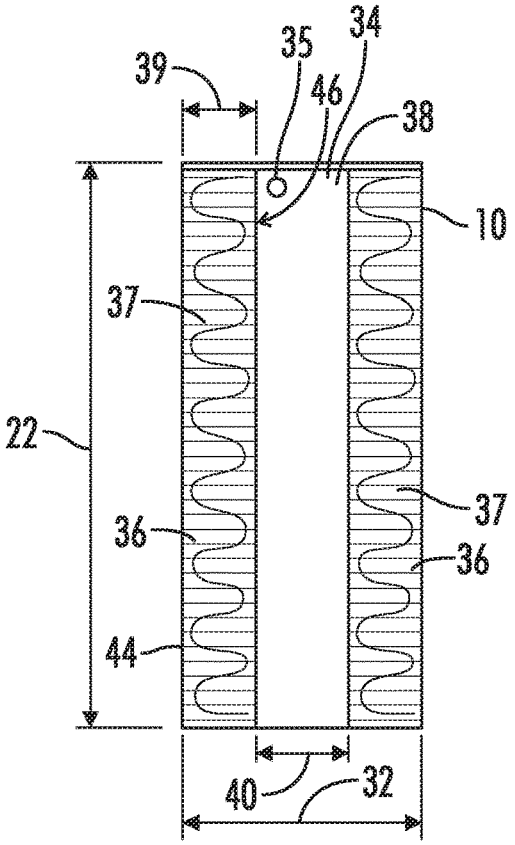
FIG. 5 is an elevation view of another embodiment of a flashing.
Figure 6:
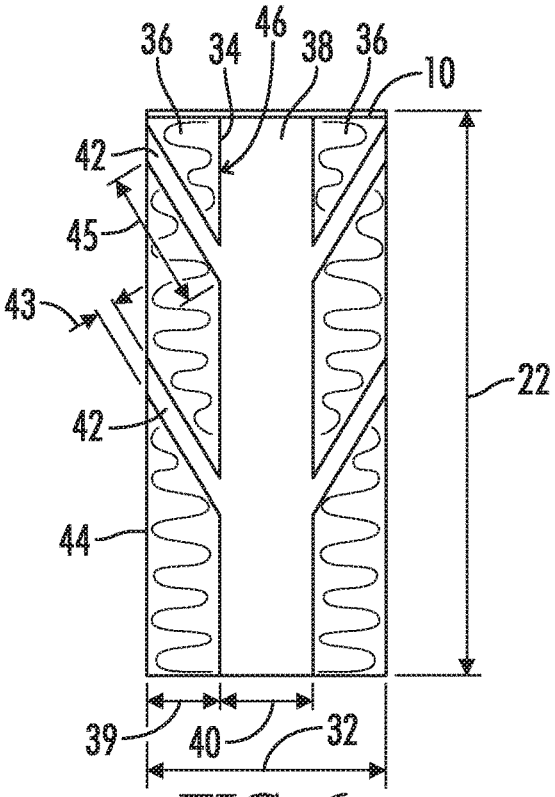
FIG. 6 is an elevation view of yet another embodiment of a flashing.

At least one strip of adhesive double-sided tape 36 may include at least one protective layer 37 covering a side of the tape that is opposite exterior face 34. At least one strip of adhesive double-sided tape 36 may be one strip, two strips (as shown in FIG. 5) or three or more strips (as shown in FIG. 6). At least one strip of adhesive double-sided tape 36 may also be perforated along line 64.

In FIG. 5, an elevation view of an embodiment of flashing 10 having two strips of adhesive double-sided tape 36 is shown. In embodiments having more than one strip of adhesive double sided tape 36, a channel 38 is disposed between the two or more strips of adhesive double sided tape 36. A butt joint 41 (not shown) of concrete board siding pieces may be positioned over channel 38. Channel 38 may have a channel width 40. In an embodiment, channel width 40 is from about 5 mm to about 50 mm. In another embodiment, channel width 40 is from about 10% to about 90% of panel width 32.

Flashing 10 can include at least one aperture 35 disposed on and through exterior face 34. At least one aperture 35 can be configured to attach flashing 10 to a belt clip of a tool belt of an installer. At least one aperture 35 may be positioned towards, or adjacent, to exterior side 44. In another embodiment, aperture 35 may be positioned towards, or adjacent, to interior side 46 of adhesive tape 36. At least one aperture 35 may be positioned substantially adjacent to guide protrusion 18. In another embodiment, at least one aperture 35 is positioned on guide protrusion 18.

FIG. 6. shows an elevation view of an embodiment of flashing 10 having at least one groove 42. At least one groove 42 may be disposed between strips of adhesive double-sided tape 36. At least one groove 42 may extend downwardly from an exterior side 44 of at least one strip of double-sided tape 36 to an interior side 46 of at least one strip of double-sided tape 36. At least one groove 42 may have a groove width 43 of from about 1 mm to about 15 mm. In another embodiment, at least one groove 42 may have a groove width 43 of from about 10% to about 50% of tape width 39. At least one groove 42 may have a groove length 45 of from about 5 mm to about 150 mm. In another embodiment, groove length 45 may be from about 100% to 250% of tape width 39. At least one groove 42 may be formed, for example, by spacedly attaching a plurality of shaped strips of adhesive double-sided tape 36 or cutting grooves into one or more adhesive double-sided tape 36. Particularly important in humid climates, at least one groove 42 can permit air flow in the area behind concrete board siding so that the area behind the siding remains dry. Moreover, the downward slope of at least one groove 42 does not allow water to pass from channel 38 to exterior side 44.

Figure 7:
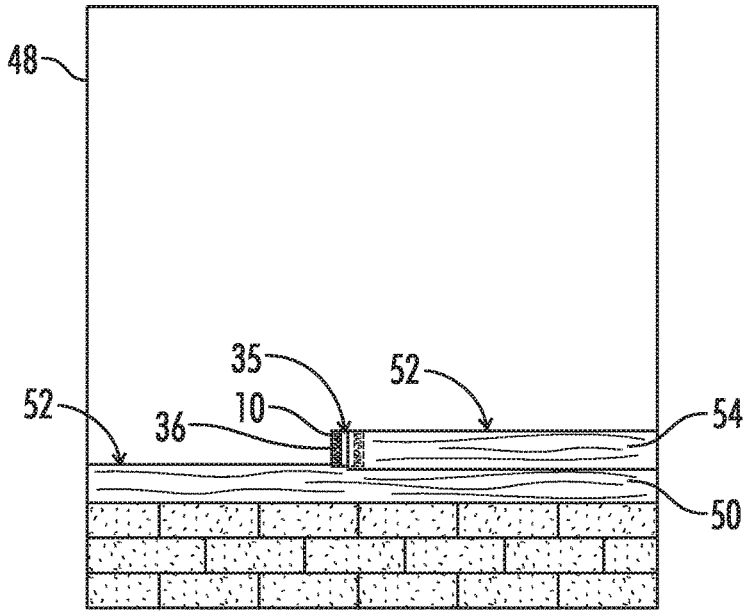
FIG. 7 is an elevation view of an embodiment of a flashing associated with a structure.

FIG. 7 shows an embodiment of flashing 10 associated with a structure 48 and a first piece of concrete board siding 50. Structure 48 may be a house, shed, barn, garage, commercial building, church and other types of building. A first piece of cement board siding 50 may be secured or fastened to structure 48. The cement board siding 50 may be fastened with, for example, screws or nails. First piece of cement board siding 50 includes a top edge 52. Interior protrusion 20 may be positioned on or disposed on top edge 52 so that interior protrusion is disposed on top edge 52.

Flashing 10 can be configured to be fastened to structure 48. Flashing 10 can be configured to be secured to structure 48 via a nail or a screw through at least one aperture 35 and into structure 48.

In an embodiment, flashing 10 has at least one strip of adhesive double-sided tape 36. At least one strip of adhesive double-sided tape 36 may include at least one protective layer 37 covering at least one strip of adhesive double-sided tape 36 to retain its adhesiveness. A second piece of concrete board siding 54 can be adhered to at least one strip of adhesive double-sided tape 36. In embodiments having at least one protective layer 37, the protective layer 37 is removed prior to adhering the second piece of concrete board siding 54. Second piece of concrete board siding 54 may then be fastened to structure 48. Structure 48 may include foam insulation board or another type of barrier material underneath flashing 10, first piece of concrete board siding 50 and second piece of concrete board siding 54. Second piece of concrete board siding 54 may be secured to structure 48.

Advantageously, at least one strip of adhesive double-sided tape 36 may retain second piece of concrete board siding 54 in place so that one installer can position and fasten the second piece of concrete board siding 54 and subsequent pieces of concrete board siding 55 (not shown). Thus, in an embodiment, the need for two or more installers for concrete board siding is eliminated.

In another embodiment, an installer may use guide protrusion 18 to guide second piece of concrete board siding 54. In particular, second piece of concrete board siding 54 can be disposed against guide protrusion 18 and then adhered to at least one strip of adhesive double-sided tape and fastened to the structure. Guiding second piece of concrete board siding 54 reduces or eliminates the need to measure for placement of second piece of concrete board siding 54 relative to first piece of concrete board siding 50.

Figure 8:
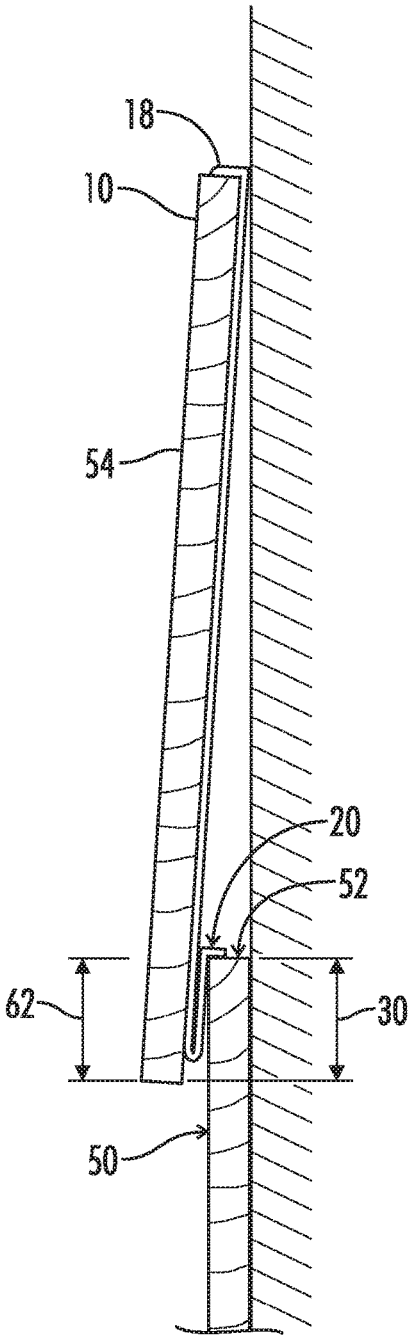
FIG. 8 is a side view of an embodiment of a flashing associated with a first piece of concrete board siding and a second piece of concrete board siding.

FIG. 8 shows a side view of an embodiment of flashing 10 associated with a first piece of concrete board siding 50 and a second piece of concrete board siding 54. Offset portion length 30 may be varied to adjust an overlap height 62 of first piece of concrete board siding 50 and second piece of concrete board siding 54. Offset portion length 30 may be from about 5 mm to about 50 mm, preferably from about 10 mm to about 30 mm, most preferably about 25 mm. In an embodiment, offset portion length 30 may have an offset portion length of from about 5% to about 25% of the panel height. Overlap height 62 may be from about 10 mm to about 50 mm, preferably about 31.75 mm.

Figure 9:
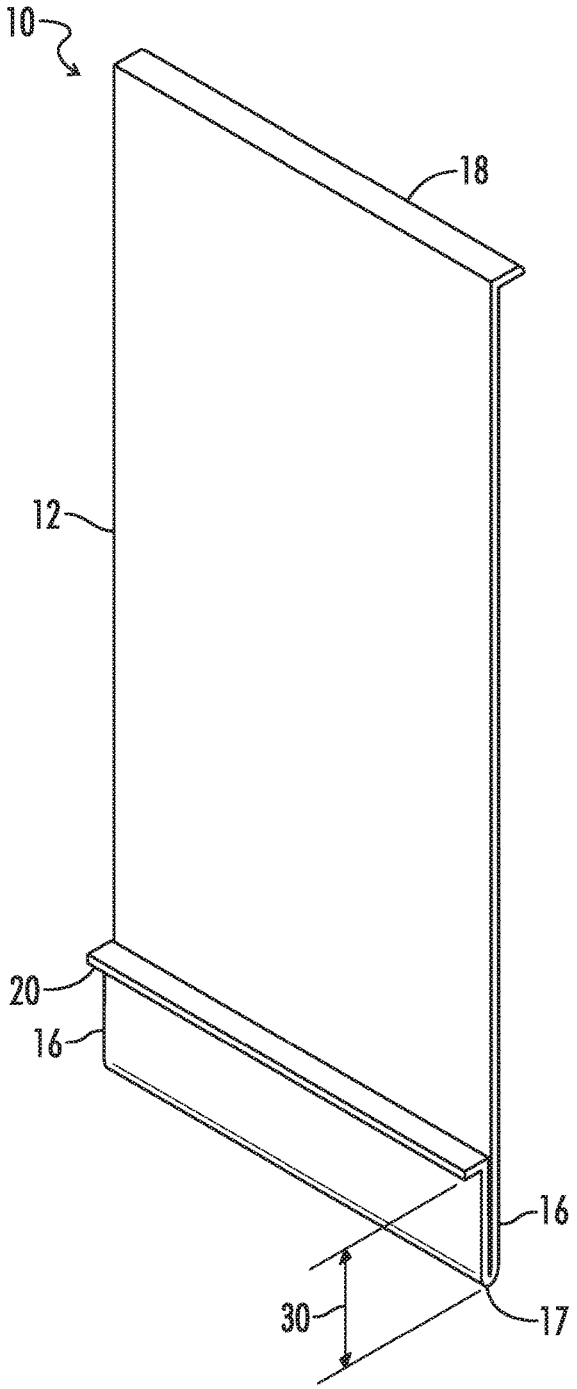
FIG. 9 is a top rear perspective view of an embodiment of a flashing.

FIG. 9 shows a top rear perspective view of an embodiment of a flashing 10. In an embodiment, flashing 10 has a panel 12 having a bottom portion 16 that is folded at bottom edge 17. Bottom edge 17 may include interior protrusion 20. Panel 12 may include guide protrusion 18. The distance between bottom edge 17 and interior protrusion 20 may be offset portion length 30.

Figure 10:
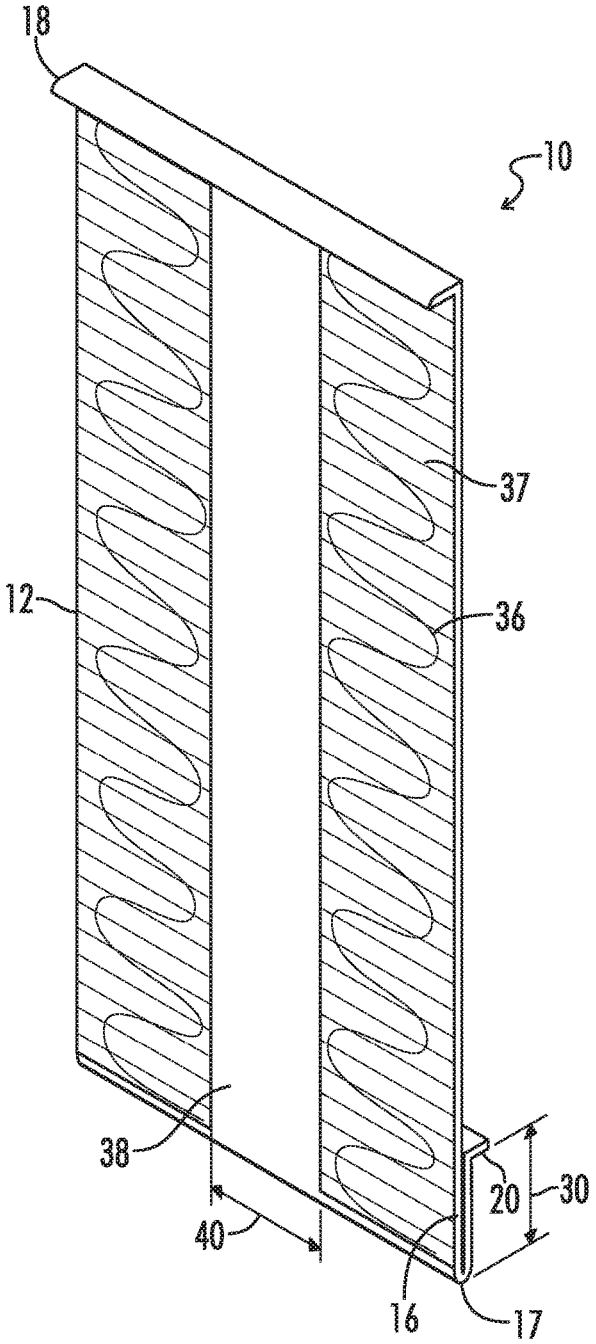
FIG. 10 is a top front perspective view of the embodiment of FIG. 9.

FIG. 10 is a top front perspective view of the embodiment of a flashing shown in FIG. 9. Panel 12 may include two strips of adhesive tape 36. Two strips of adhesive tape 36 may be protected by protective layers 37. Channel 38 may separate two strips of adhesive tape 36 and have a channel width 40.

Although embodiments of the disclosure have been described using specific terms, devices, and methods, such description is for illustrative purposes only. The words used are words of description rather than of limitation. It is to be understood that changes and variations may be made by those of ordinary skill in the art without departing from the spirit or the scope of the present disclosure, which is set forth in the following claims. In addition, it should be understood that aspects of the various embodiments may be interchanged in whole or in part. Therefore, the spirit and scope of the appended claims should not be limited to the description of the versions contained therein.

Any range provided herein provides support and a basis for any subset within that range.

Thus, although there have been described particular embodiments of the present invention of a new and useful flashing and method of installing concrete board siding, it is not intended that such references be construed as limitations upon the scope of this invention except as set forth in the following claims.

What is claimed is:

1. A flashing for installing siding to a structure having an outer side, comprising:

a substantially rigid panel including a top portion, a bottom portion, and an exterior face;

a top edge integrally formed with the top portion, the top edge defining a guide protrusion extending and terminating in an orthogonal direction away from the exterior face;

a bottom edge disposed on the bottom portion, the bottom edge disposed oppositely on the flashing from the top edge;

an interior protrusion integrally formed with the bottom portion and spaced a distance from the bottom edge, the interior protrusion extending and terminating along a direction generally opposite of the direction of the guide protrusion; and at least one strip of adhesive double-sided tape adhered to the exterior face, wherein the exterior face faces away from the outer side of the structure.

2. The flashing of claim 1, wherein the panel has a panel height of from about 50 mm to about 500 mm.

3. The flashing of claim 1, wherein the interior protrusion includes an interior protrusion length of between about 2 mm and about 25 mm.

4. The flashing of claim 1, wherein the distance has a length of from about 5 mm to about 50 mm.

5. The flashing of claim 1, wherein the interior protrusion and the bottom portion form an offset portion junction having an angle of from 0 degrees to about 40 degrees.

6. The flashing of claim 1, wherein the panel includes a panel width of from about 75 mm to about 2000 mm.

7. The flashing of claim 1, wherein the at least one strip of adhesive double-sided tape includes two strips of adhesive double-sided tape.

8. The flashing of claim 7, wherein the two strips of adhesive-double sided tape are separated by a channel.

9. The flashing of claim 8, wherein each strip of adhesive-double sided tape includes a tape width of from about 5 mm to about 60 mm.

10. The flashing of claim 1, wherein the at least one strip of adhesive double-sided tape includes at least one groove.

11. The flashing of claim 10, wherein the at least one strip of adhesive double-sided tape includes an exterior side and an internal side, and the at least one groove diagonally extends downward from the exterior side to the internal side.

12. The flashing of claim 1, wherein the guide protrusion and top portion form a guide protrusion junction having an angle of from about 70 degrees to about 110 degrees.

13. The flashing of claim 1, wherein the interior protrusion and bottom portion form an interior protrusion junction having an angle of from about 70 degrees to about 110 degrees.

14. The flashing of claim 1, wherein the panel is configured to be broken along a perforation line and resized to accommodate a corresponding piece of cement board siding.

15. The flashing of claim 1, wherein the offset portion and the bottom portion form an offset portion junction having an angle of from 0 degrees to about 5 degrees.

16. The flashing of claim 1, further comprising at least one aperture disposed through the exterior face.

17. The flashing of claim 16, further comprising an exterior side, wherein the at least one aperture is disposed proximate to the exterior side.

18. The flashing of claim 1, further comprising at least one aperture disposed through the guide protrusion.

19. The flashing of claim 1, wherein the interior protrusion and the bottom portion form an interior protrusion junction having an angle of from about 70 degrees to about 110 degrees.

* * * * *